US005266971A

United States Patent [19]

Yoshida et al.

[11] Patent Number: 5,266,971

[45] Date of Patent: Nov. 30, 1993

[54] THERMAL TRANSFER RECORDING APPARATUS AND FACSIMILE APPARATUS UTILIZING THE SAME

[75] Inventors: Takehiro Yoshida, Tokyo; Takeshi Ono, Yokohama; Satoshi Wada, Kawasaki; Tomoyuki Takeda, Yokohama; Masaya Kondo, Tokyo; Makoto Kobayashi, Tama; Takahiro Kato; Takashi Awai, both of Yokohama; Yasushi Ishida, Tokyo; Akihiro Tomoda, Yokohama; Minoru Yokoyama, Yokohama; Masakatsu Yamada, Yokohama, all of Japan

[73] Assignee: Canon Kabushiki Kaisha, Tokyo, Japan

[21] Appl. No.: 647,259

[22] Filed: Jan. 29, 1991

[30] Foreign Application Priority Data

Feb. 1, 1990 [JP] Japan ..... 2-20402

[51] Int. Cl.[5] ..... B41J 2/32

[52] U.S. Cl. ..... 346/76 PH; 400/232; 400/120; 358/296

[58] Field of Search ..... 400/232, 120; 346/76 PH; 358/296

[56] References Cited

U.S. PATENT DOCUMENTS

| | | | |
|---|---|---|---|
| 3,855,448 | 12/1974 | Hanagata et al. | 219/216 |
| 4,421,428 | 12/1983 | Noda et al. | 400/120 |
| 4,814,789 | 3/1989 | Ono | 346/76 PH |

FOREIGN PATENT DOCUMENTS

| | | | |
|---|---|---|---|
| 57-83471 | 5/1982 | Japan . | |
| 62-58917 | 1/1983 | Japan . | |
| 58-201686 | 11/1983 | Japan . | |
| 0095177 | 6/1984 | Japan . | |
| 59-98882 | 6/1984 | Japan . | |
| 60-217176 | 10/1985 | Japan . | |
| 0087381 | 4/1987 | Japan | 400/232 |
| 0022082 | 1/1990 | Japan | 400/232 |

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

There is disclosed a thermal transfer recording apparatus in which the ratio of amount of transportation of ink sheet to that of recording sheet is varied according to a measured condition, for example head temperature, of the apparatus. When the temperature or humidity is higher, facilitating the ink transfer from the ink sheet, the ink sheet is advanced by a smaller amount to economize the consumption of the ink sheet.

9 Claims, 11 Drawing Sheets

FIG. 6

| TEMPERATURE OF SENSOR 133 | VALUE OF n |
|---|---|
| t > 35° | LARGE |
| 35° ≧ t > 25° | MIDDLE |
| 25° ≧ t | SMALL |

FIG. 7

| MOVED DISTANCE OF RECORDING PAPER PER HALF STEP | | $\frac{1}{15.4}$ mm |
|---|---|---|
| THE NUMBER OF HALF STEPS ON LINE | SUPER FINE | 1 |
| | FINE | 2 |
| | STANDARD | 4 |

FIG. 9

| HUMIDITY | VALUE OF n |
|---|---|
| h > 70% | LARGE |
| 70% ≧ h > 50% | MIDDLE |
| 50% ≧ h | SMALL |

FIG. 8

| MOVED DISTANCE OF INK SHEET PER HALF STEP | | | $\frac{1}{15.4} \times \frac{1}{5} \times \frac{1}{5}$ mm | VALUE OF n |
|---|---|---|---|---|
| THE NUMBER OF HALF STEPS ON LINE | SUPER FINE | n → LARGE | 4 | $\frac{25}{4}$ |
| | | n → MIDDLE | 5 | 5 |
| | | n → SMALL | 6 | $\frac{25}{6}$ |
| | FINE | n → LARGE | 8 | $\frac{25}{4}$ |
| | | n → MIDDLE | 10 | 5 |
| | | n → SMALL | 12 | $\frac{25}{6}$ |
| | STANDARD | n → LARGE | 16 | $\frac{25}{4}$ |
| | | n → MIDDLE | 20 | 5 |
| | | n → SMALL | 24 | $\frac{25}{6}$ |

THERMAL TRANSFER RECORDING APPARATUS AND FACSIMILE APPARATUS UTILIZING THE SAME

BACKGROUND OF THE INVENTION

1. Field of the Invention

The present invention relates to a thermal transfer recording apparatus for image recording on a recording medium by transfer of ink from an ink sheet, and a facsimile apparatus utilizing such recording apparatus.

2. Related Background Art

In general the thermal transfer printer utilizes an ink sheet consisting of a substrate film coated with heat-fusible (or heat-sublimable) ink, and effects image recording by selectively heating said ink sheet with a thermal head according to an image signal, thereby transferring thus fused (or sublimed) ink onto a recording sheet. Since said ink sheet is generally so-called one-time ink sheet in which the ink is completely transferred to the recording sheet by a single image recording, it is necessary, after the image recording of a character or a line, to advance the ink sheet corresponding to the recorded length, thereby securely bringing an unused portion of the ink sheet to the next recording position. Consequently the amount of use of the ink sheet increases, and such thermal transfer printers tend to have a higher running cost in comparison with ordinary thermal printers utilizing thermosensitive recording paper.

In order to solve the foregoing problem, there have already been proposed thermal transfer printers in which the recording sheet and the ink sheet are transported with different speeds, as disclosed in the Japanese Laid-open Patents Application No. 57-83471 and No. 58-201686 and in the Japanese Patent Publication No. 62-58917.

Also for use in such thermal transfer printers, there is already known a multi-print ink sheet capable of plural (n) image recordings. In continuous image recording of a length L, such ink sheet allows to reduce the length thereof, transported during or after said image recording, to a value smaller than L (said value being L/n; $n>1$). The efficiency of use of the ink sheet can therefore be increased to n times of the conventional efficiency, and a reduction in the running cost of the thermal transfer printer can be expected. Such recording method will hereinafter be called the multi printing method.

In the conventional multi printing, however, the value n is determined independently from the temperature of thermal head, or the ambient temperature and humidity of the location where the apparatus is installed. In thermal transfer printers, a higher temperature of the thermal head or inside the thermal transfer printer facilitates the fusing of ink of the ink sheet, thereby facilitating the recording operation. Consequently the recording operation can be conducted with a larger value of n, namely with a smaller ratio of the amount of transportation of the ink sheet to that of the recording sheet.

On the other hand, a lower temperature of the thermal head or inside the printer hinders the fusion of ink of the ink sheet, thus rendering the recording operation more difficult. Consequently, the recording operation has to be conducted with a smaller value of n, namely with a larger ratio of the amount of transportation of the ink sheet to that of the recording sheet. However the value n in the conventional printers has been selected independently from the temperature, so that the ink sheet has not been utilized efficiently.

SUMMARY OF THE INVENTION

In consideration of the. foregoing, an object of the present invention is to provide an improved thermal transfer recording apparatus and a facsimile apparatus utilizing such recording apparatus.

Another object of the present invention is to provide a thermal transfer recording apparatus capable of saving the consumption of the ink sheet, and a facsimile apparatus utilizing such recording apparatus.

Still another object of the present invention is to provide a thermal transfer recording apparatus capable of saving the consumption of the ink sheet and recording a satisfactory image by decreasing or increasing the amount of transportation of the ink sheet respectively under an easy or difficult condition for ink transfer, and a facsimile apparatus utilizing such recording apparatus.

The foregoing and still other objects of the present invention will become fully apparent from the following description to be taken in conjunction with the attached drawings.

BRIEF DESCRIPTION OF THE DRAWINGS

FIG. 6 is a chart showing the relationship between the temperature t of the temperature sensor and the value n in the present embodiment;

FIG. 7 is a chart showing the transported distance of the recording sheet in different modes;

FIG. 8 is a chart showing the transported distance of the ink sheet in different modes;

FIG. 9 is a chart showing the relationship between humidity and n in another embodiment;

DESCRIPTION OF THE PREFERRED EMBODIMENTS

Now the present invention will be clarified in detail by preferred embodiments thereof shown in the attached drawings.

Facsimile apparatus (FIGS. 1 to 4)

Figure 1:
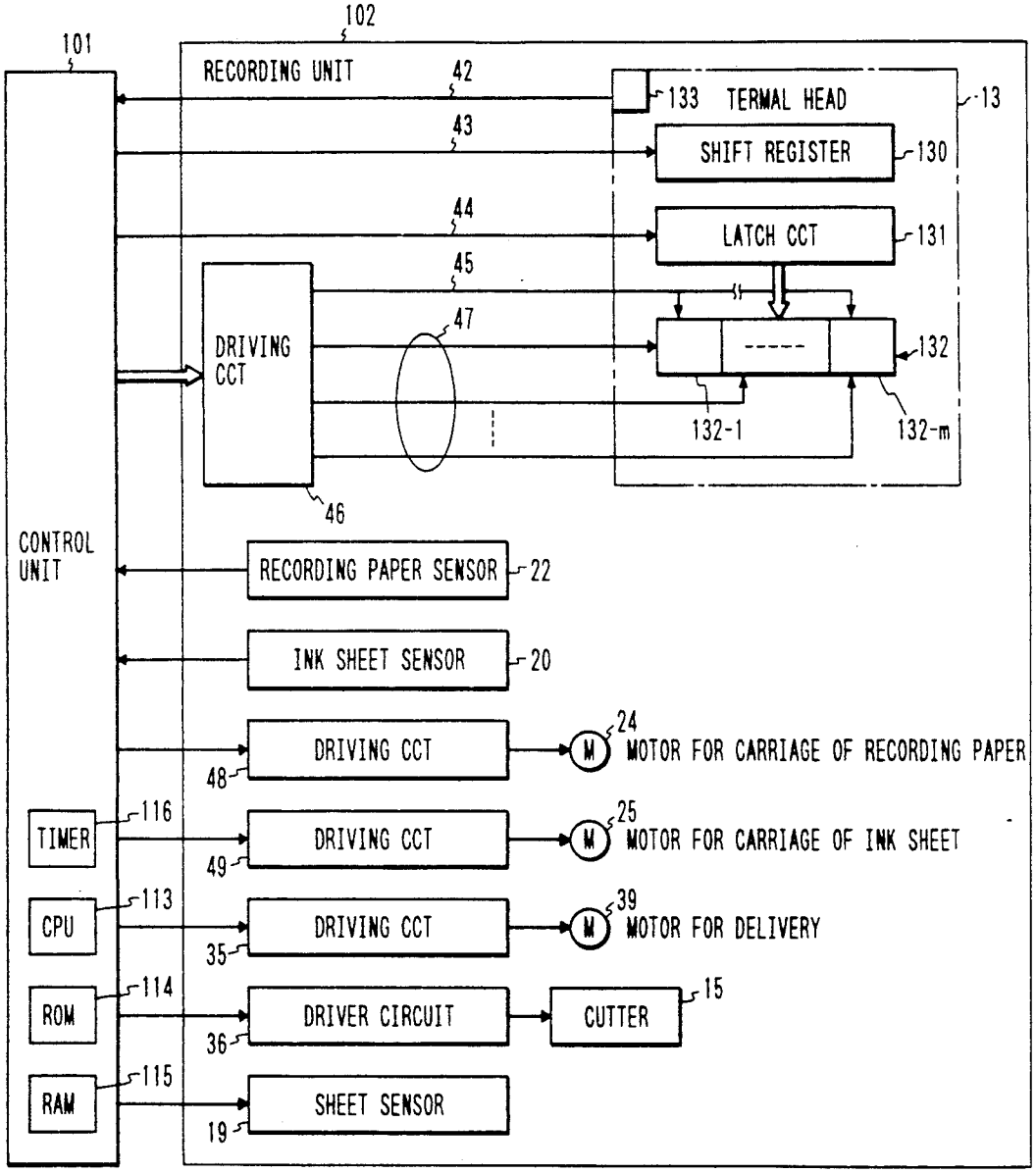
FIG. 1 is a block diagram showing electric connections between a control unit and a recording unit in a facsimile apparatus embodying the present invention.
Figure 2:
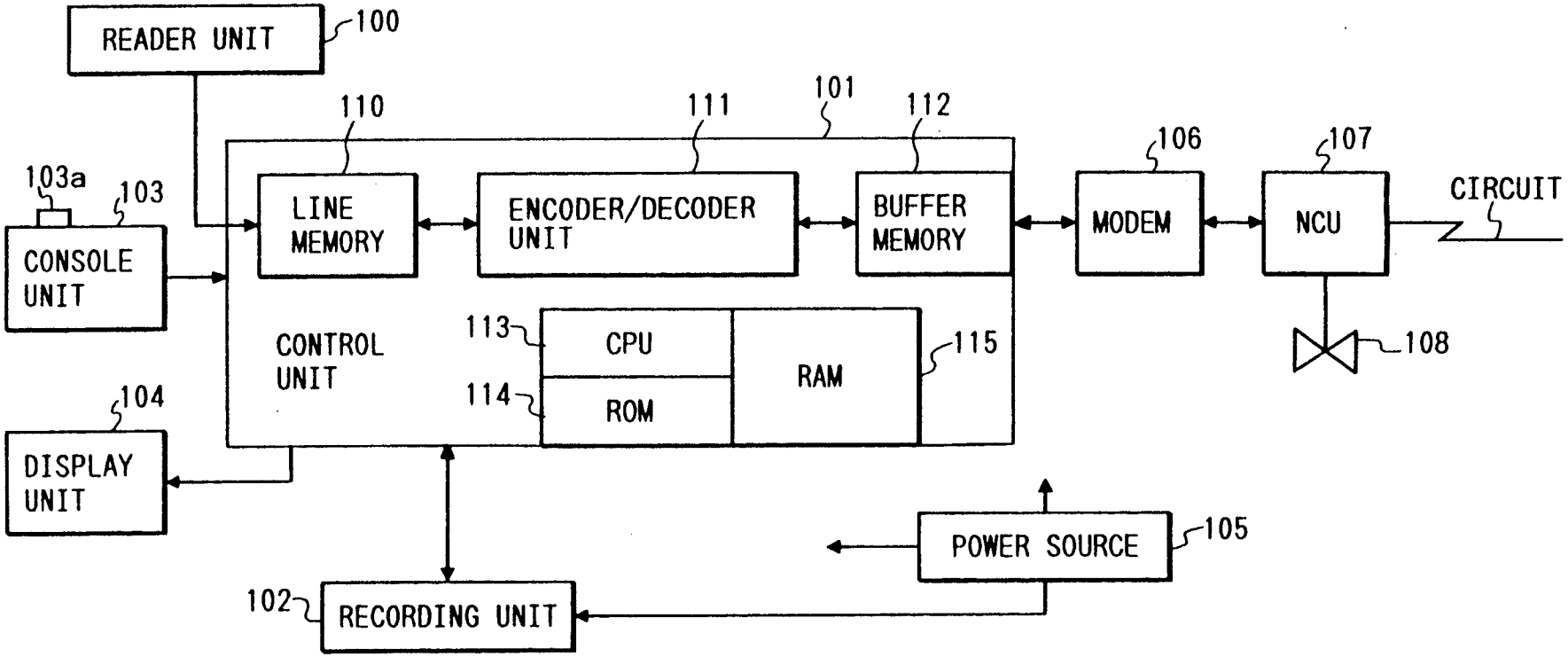
FIG. 2 is a block diagram showing schematic structure of the facsimile apparatus of said embodiment.
Figure 3:
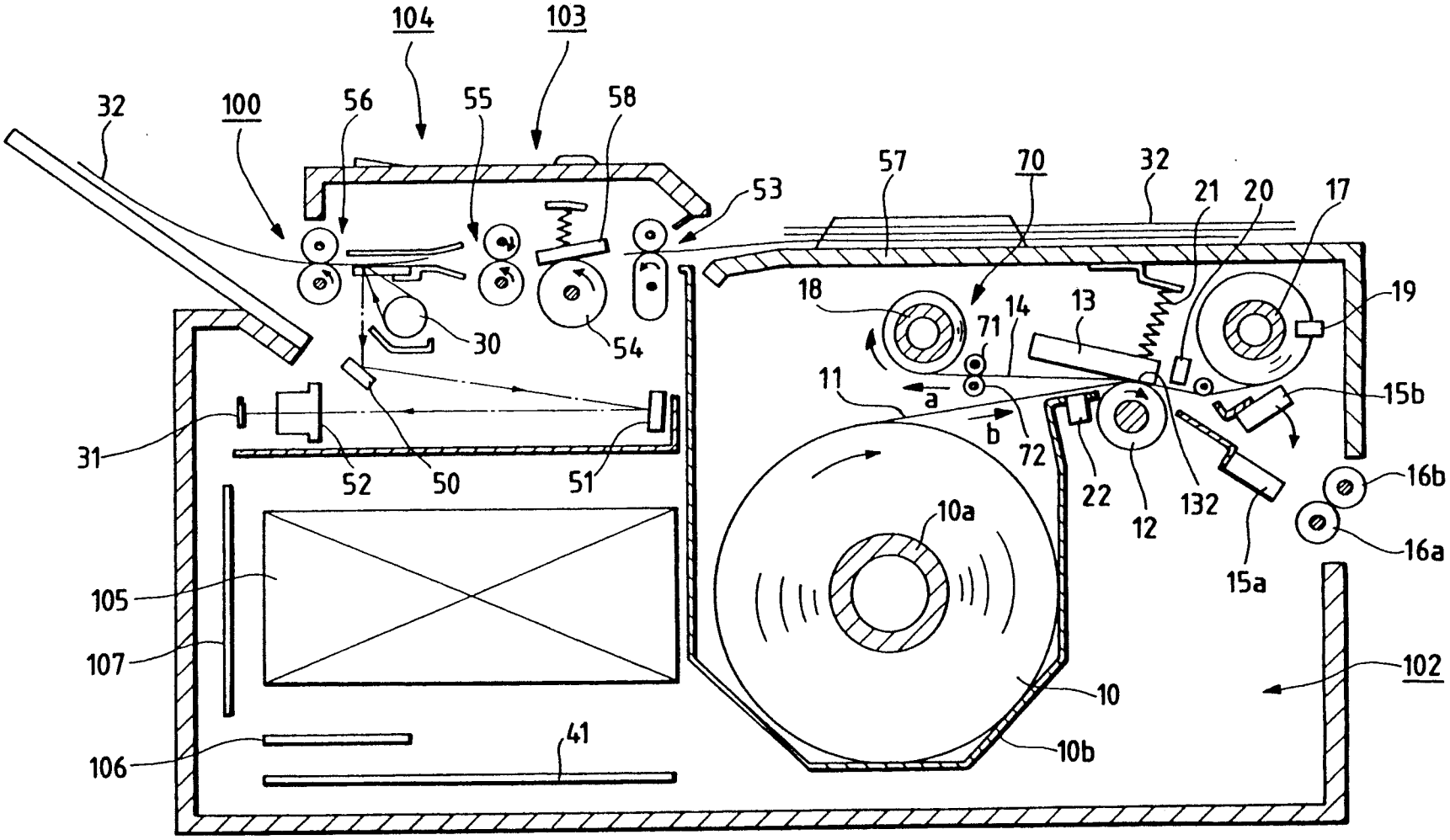
FIG. 3 is a lateral cross-sectional view showing the mechanism of said facsimile apparatus.
Figure 4:
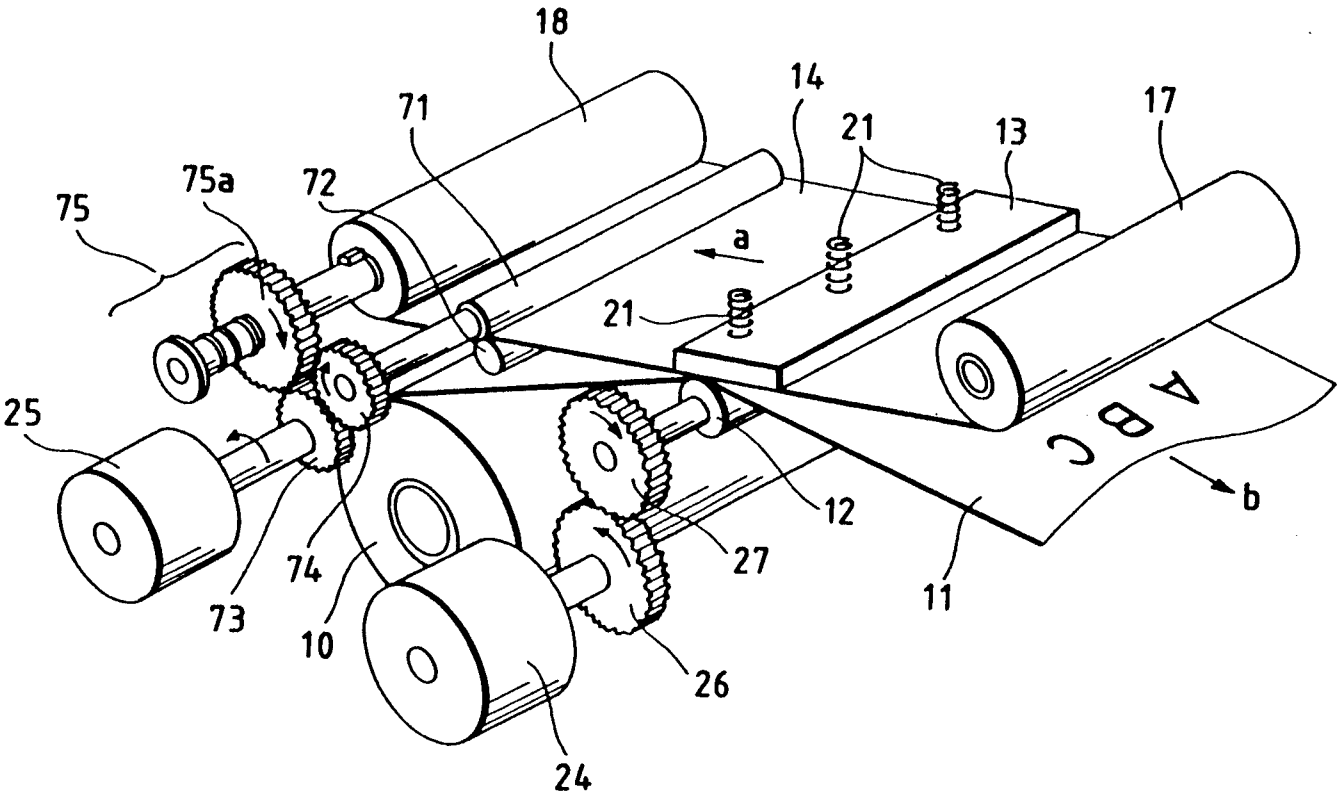
FIG. 4 is a perspective view showing a transport mechanism for the recording sheet and the ink sheet.
Figure 5A:
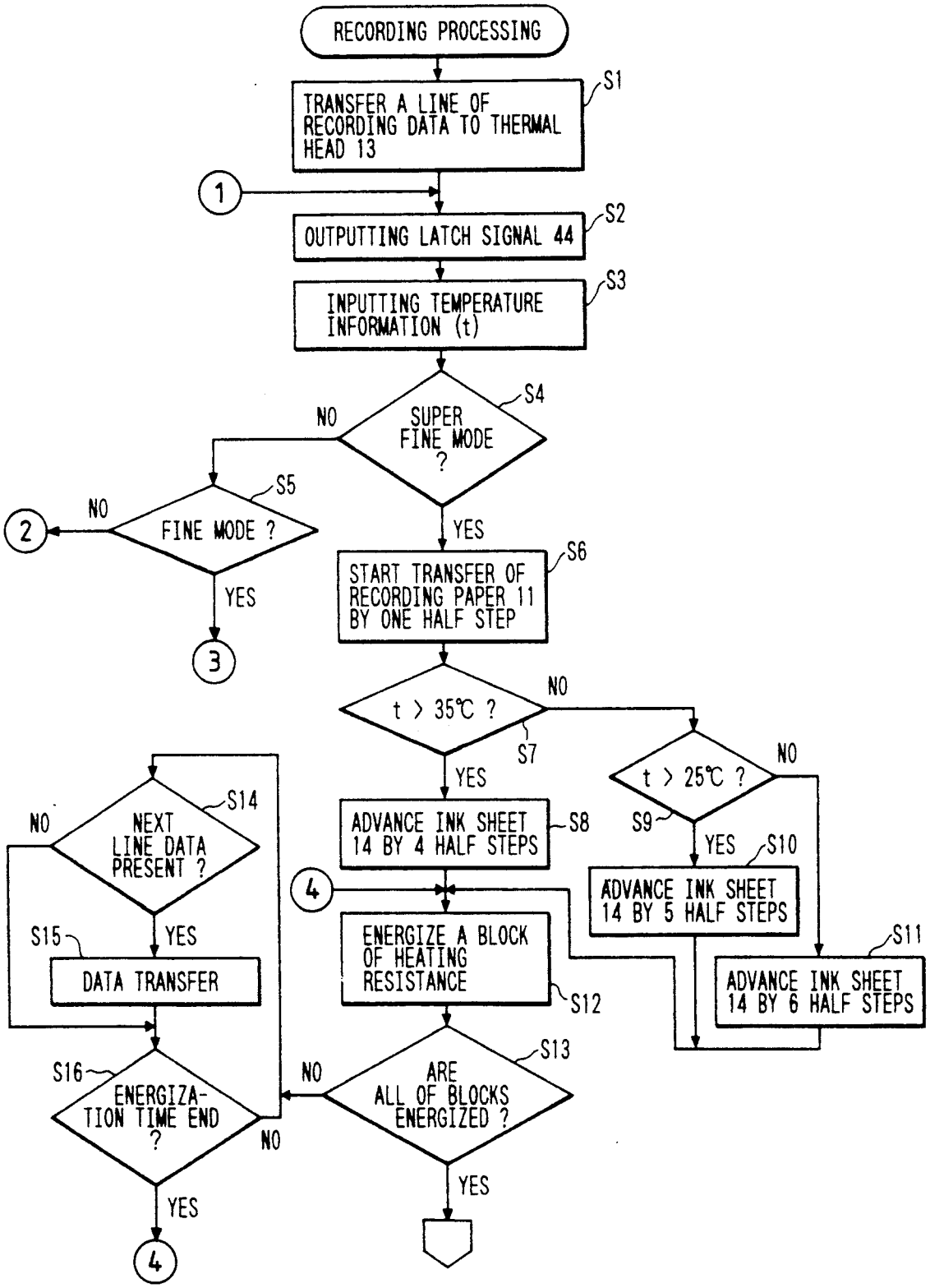
FIGS. 5A to 5D are flow charts of the recording sequence of the present embodiment.
Figure 5B:
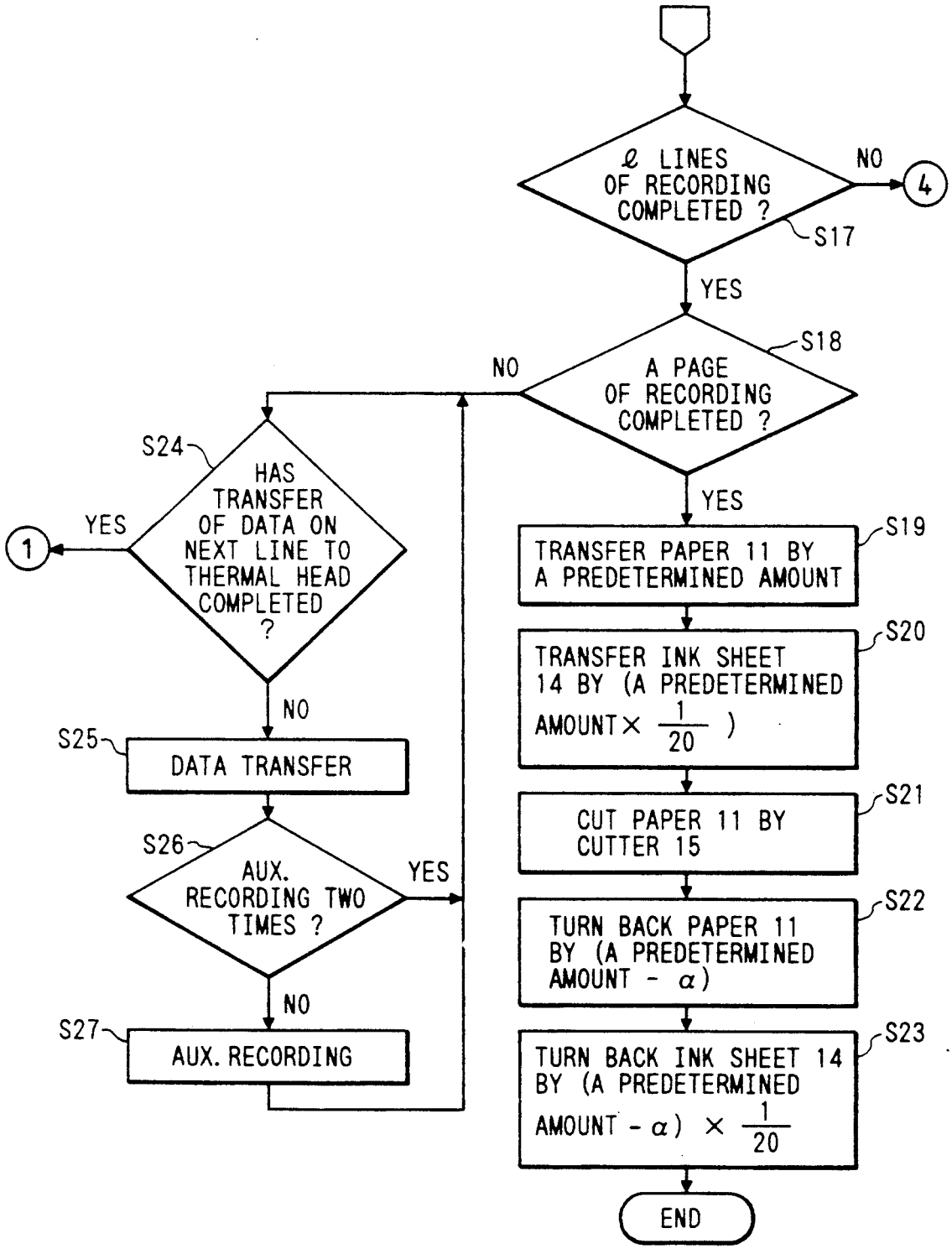
Figure 5C:
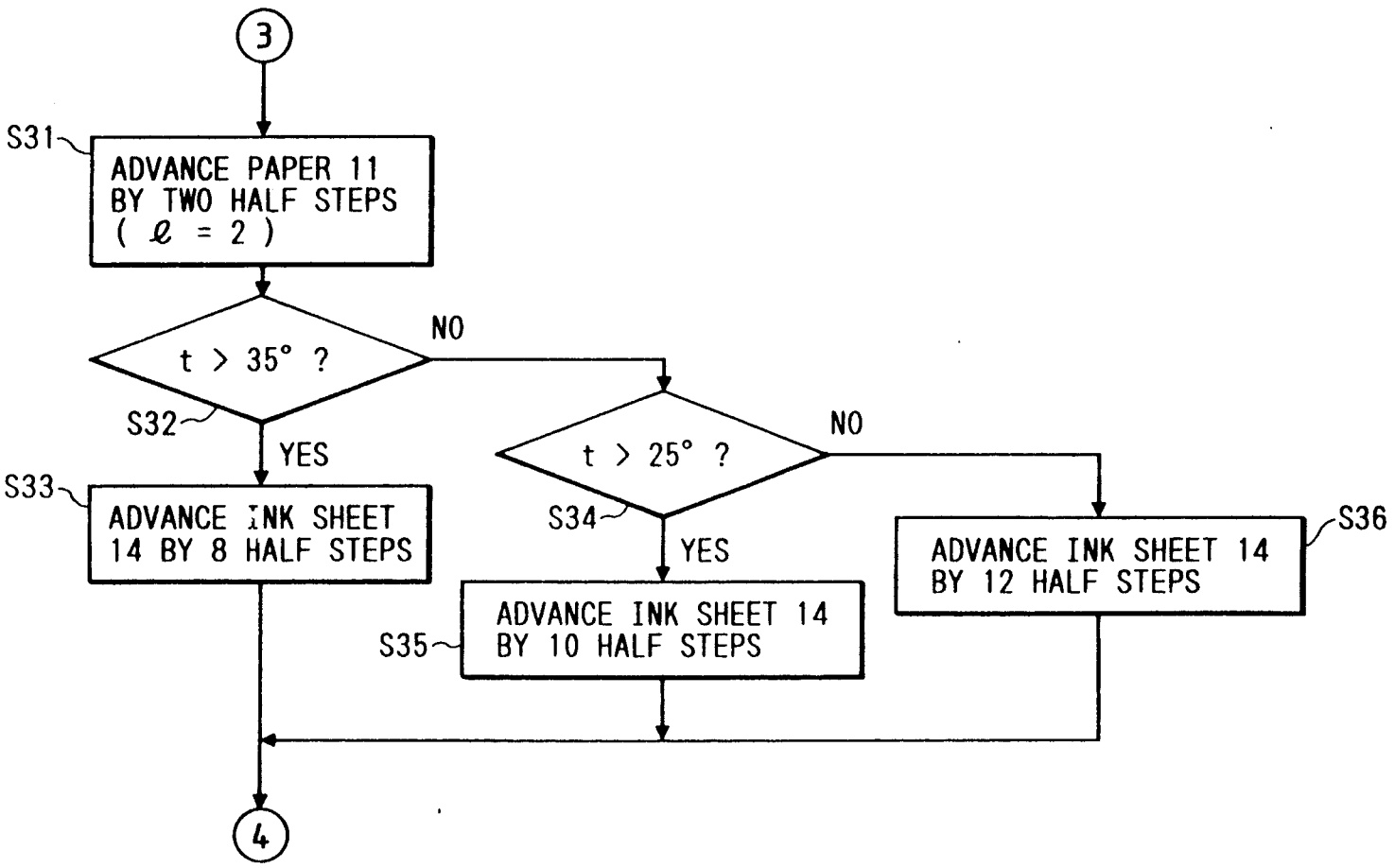
Figure 5D:
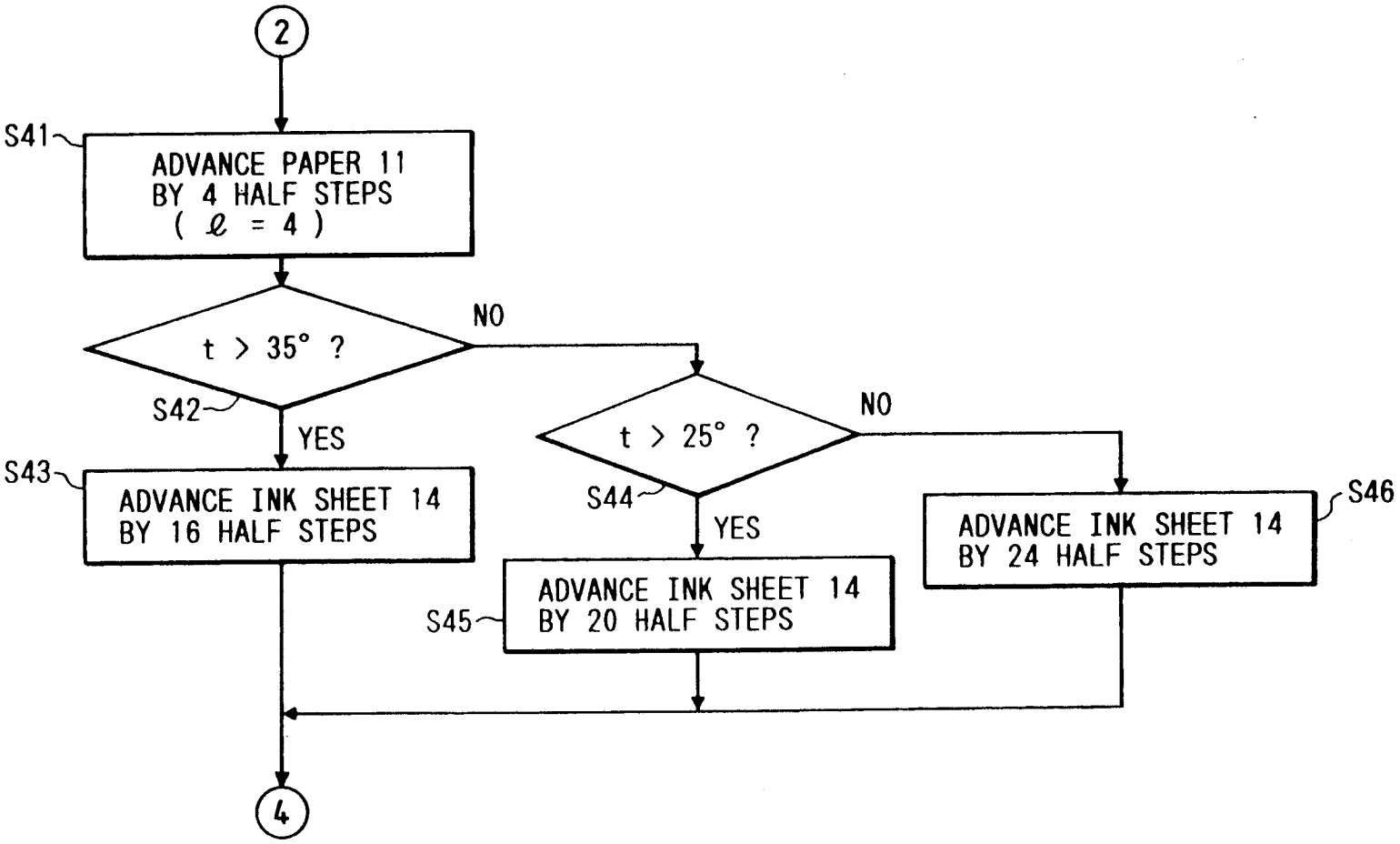

FIGS. 1 to 4 show a thermal transfer recording apparatus embodying the present invention and applied to a facsimile apparatus, wherein FIG. 1 is a block diagram showing electrical connections between a control unit 101 and a recording unit 102 of the facsimile apparatus; FIG. 2 is a block diagram of the schematic structure of said facsimile apparatus; FIG. 3 is a lateral cross-sectional view of the facsimile apparatus; and FIG. 4 is a perspective view of a transport mechanism for a recording sheet 1 and an ink sheet 14 in the recording unit 102.

At first reference is made to FIG. 2 for explaining the schematic structure of the facsimile apparatus constituting an embodiment of the present invention.

A reader unit 100 for photoelectrically reading an original image and sending a digital image signal to a control unit 101, is provided with an original transporting motor and a CCD image sensor. The control unit 101 is constructed in the following manner. A line memory 110, for storing image data of each line, serves to store the image data of a line from the reader unit 100 in case of the original transmitting or copying mode, or the received and decoded image data of a line in case of the image data receiving mode. The image formation is conducted by transferring thus stored data to the recording unit 102. An encoder/decoder unit 111 encodes the image information to be transmitted for example by MH encoding, and decodes the received encoded data into image data. A buffer memory 112 stores image data which are to be transmitted or which have been received. These units of the control unit 101 are controlled by a CPU 113 composed for example of a microprocessor. The control unit 101 is further provided with a ROM 114 storing control programs of the CPU 113 and other various data, and a RAM 115 functioning as a work area for the CPU 113 and serving to temporarily store various data.

A recording unit 102 is provided with a thermal line head and serves to record an image on the recording sheet by thermal transfer recording method. The details of said recording unit will be explained later with reference to FIG. 3. An operation console unit 103 is provided with various functional keys for example for starting the transmission, and telephone number input keys. A key 103*a* thereof, used for instructing the kind of the ink sheet used, indicates a multi-printing ink sheet or an ordinary ink sheet respectively when said switch 103*a* is on or off. There are also provided a display unit 104, usually positioned next to the operation console unit and used for displaying the state of various functions or of the apparatus; a power source unit 105 for supplying the entire apparatus with electric power; a modem (modulator/demodulator) 106; a network control unit (NCU) 107 for effecting an automatic call receiving operation by detecting the call tone and a line controlling operation; and a telephone unit 108.

In the following there will be given a detailed explanation on the structure of the recording unit 102, with reference to FIG. 3, in which same components as those in the preceding drawings are represented by same numbers.

Referring to FIG. 3, a sheet roll 10, composed of plain recording paper 11 wound on a core 10*a*, is rotatably supported in the apparatus so as to feed the recording sheet 11 to a thermal head 13 by the rotation of a platen roller 12 in a direction indicated by an arrow. A sheet roll holding unit 10*b* removably holds the sheet roll 10. The platen roller 12 serves to transport the recording sheet 11 in a direction b, and to press an ink sheet 14 and the recording sheet 11 toward heat-generating resistors 132 of the thermal head 13. The recording sheet 11, which has been subjected to image recording by the heat generation of the thermal head 13, is transported toward discharge rollers 16 (16*a*, 16*b*) by further rotation of the platen roller 12, and, upon completion of image recording of a page, is cut into a page-sized sheet by mutual engagement of cutter members 15 (15*a*, 15*b*).

An ink sheet feeding roller 17 on which the ink sheet 14 is wound, and an ink sheet take-up roller 18 are driven by an ink sheet transport motor to be explained later, thereby taking up the ink sheet 14 in a direction a. Said ink sheet feeding roller 17 and ink sheet take-up roller 18 are detachably loaded in an ink sheet loading unit 70 in the main body of the apparatus. There are also provided a sensor 19 for detecting the remaining amount and the transport speed of the ink sheet 14; an ink sheet sensor 20 for detecting presence or absence of the ink sheet 14; a spring 21 for pressing the thermal head 13 to the platen roller 12 across the recording sheet 11 and the ink sheet 14; and a recording sheet sensor 22 for detecting presence or absence of the recording sheet.

In the following explained is the structure of the reader unit 100.

A light source 30 illuminates an original 32. The light reflected by said original 32 passes through an optical system (mirrors 50, 51 and a lens 52), enters a CCD sensor 31 and converted into electrical signals therein. The original 32 is transported with a speed corresponding to the reading speed of said original 32, by transport rollers 53, 54, 55, 56 driven by an unrepresented transport motor. An original stacker table 57 supports plural originals 32 which are separated one by one and advanced to the reader unit 100, through the operation of a transport roller 54 and a separating member 58.

A control circuit board 41, constituting the principal part of the control unit 101, sends various control signals to various parts of the apparatus. There are also provided a power source unit 105 for supplying electric power to the various parts of the apparatus; a modem board unit 106; and an NCU board unit 107 for making connection with the external telephone lines.

FIG. 4 shows the details of the transport mechanism for the ink sheet 14 and the recording sheet 11.

In FIG. 4 there are shown a recording sheet transport motor 24 for rotating the platen roller 12 thereby transporting the recording sheet 11 in a direction b opposite to the direction a; an ink sheet transport motor 25 for transporting the ink sheet 14 in the direction a by means of a capstan roller 71 and a pinch roller 72; gears 26, 27 for transmitting the rotation of the recording sheet transport motor 24 to the platen roller 12; gears 73, 74 for transmitting the rotation of the ink sheet transport motor 25 to the capstan roller 71; and a slip clutch unit 75.

The ink sheet 14 advanced by the capstan roller 71 can be securely wound on the take-up roller 18, by selecting the ratio of the gears 74, 75 in such a manner that the length of the ink sheet wound on the take-up roller 18 by the rotation of the gear 75*a* is larger than that transported by the capstan roller 71. The difference between the length of the ink sheet 14 wound by the take-up roller 18 and that advanced by the capstan roller 71 is absorbed by the slip clutch unit 75. It is thus made possible to prevent fluctuation in the transport speed (or amount) of the ink sheet 14, resulting from change in the winding diameter of the take-up roller 18.

FIG. 1 shows the electric connections of the control unit 101 and the recording unit 102 of the facsimile apparatus of the present embodiment, wherein same components as those in other drawings are represented by same numbers.

The thermal head 13, constructed as a line head, is provided with a shift register 130 for receiving serial recording data or shift clock signals 43 of a line from the control unit 101, a latch circuit 131 for latching the data of the shift register 130 by a latch signal 44; and heat-generating resistors 132 of a line, which are divided into m blocks for driving, as illustrated by 132-l - 132-m.

A temperature sensor 133 is mounted on the thermal head 13 for detecting the temperature thereof. An output signal 42 of said sensor 133 is A/D converted in the control unit 101 and supplied to the CPU 113, which thus detects the temperature of the thermal head 13 and regulates the energy supplied thereto according to the characteristics of the ink sheet 14, for example by varying the pulse duration of a strobe signal 47 or the driving voltage of the thermal head 13. A programmable timer 116 is set for the measurement of a time by the CPU 113, starts time measurement upon receiving a command therefor, and sends an interruption signal or a time-out signal to the CPU 113 after the lapse of each designated time.

The characteristic or kind of the ink sheet 14 may be identified by the state of the switch 103*a* of the operation console unit 103 explained before, or by a mark printed on said ink sheet 14, or by a mark, a notch or a projection provided on the cartridge of the ink sheets.

A drive circuit 46 receives drive signals for the thermal head 13 from the control unit 101, and releases strobe signals 47 for driving each block of the thermal head 13. Said drive circuit 46 is capable, in response to an instruction from the control unit 101, of varying the voltage supplied to a power supply line 45 for driving the heat-generating resistors 132 of the thermal head 13, thereby varying the energy supplied thereto. A drive circuit 36 for the cutter members 15 includes a cutter driving motor. A sheet discharge motor 39 drives the sheet discharge rollers 16. Drive circuits 35, 48, 49 are provided for respectively driving the sheet discharge motor 39, recording sheet transport motor 24 and ink sheet transport motor 25. These motors are composed of stepping motors in the present embodiment, but other motors, for example DC motors, may be employed for this purpose.

Recording process (FIGS. 1–6)

FIG. 5 is a flow chart of a recording sequence in the facsimile apparatus of the present embodiment, and a corresponding control program is stored in the ROM 114 of the control unit 101. This sequence is started when image data of a line are stored in the line memory 110 and become ready for image recording. It is assumed that the control unit 101 detects the loading of a multi ink sheet for example through the switch 103*a*.

At first a step S1 transfers the recording data of a line to the shift register 130. Upon completion of transfer of the recording data of a line, a step S2 releases a latch signal 44 to store the recording data of a line in the latch circuit 131. Then a step S3 enters the temperature information from the temperature sensor 133, and stores the corresponding temperature value (t) in the RAM 115.

Then, steps S4 and S5 discriminate the recording mode, and the sequence proceeds to a step S6, S31 or S41 respectively in case of a super fine mode, a fine mode or a standard mode. In the super fine mode, the step S6 starts the transportation of the recording sheet 11 by a half step and sets the number l of repeated line recordings at "1". A half step advances the recording sheet by 1/15.4 mm, and the ink sheet by (1/15.4×1/5×1/5) mm.

Then a step S7 discriminates whether the temperature t detected by the temperature sensor 133 exceeds 35° C., and, if affirmative, the sequence proceeds to a step S8 to start the transportation of the ink sheet 14 by 4 half steps. If the temperature t does not exceed 35° C. but exceeds 25° C., the sequence proceeds from a step S9 to S10 to start the transportation of the ink sheet 14 by 5 half steps. If the temperature t is equal to or less than 25° C., the sequence proceeds to a step S11 to start the transportation of the ink sheet 14 by 6 half steps.

Then the sequence proceeds to a step S12 to energize one of the blocks of the heat generating resistors 132 of the thermal head 13. A step S13 then discriminates whether all the blocks of the heat generating resistors 132 of the thermal head 13 have been energized, and, if not, the sequence proceeds to step S14–S16 to transfer the recording data of next line to the shift register 130 of the thermal head 13. When the energization of a block is completed in the step S16, the sequence returns to ,the step S12 for energization of a next block. In the present embodiment, the thermal head 13 is driven in 4 blocks (m=4), so that the time required for recording of a line in the super fine mode is about 2.5 ms (600 μs×4 blocks).

When the step S13 identifies the energization of all the blocks, indicating the completion of recording of a line, the sequence proceeds to a step S17 to discriminate whether the recording of l lines, corresponding to respective recording mode, has been completed. If ( lines have not been recorded, the sequence returns to the step S12 to start the transportation of the recording sheet 11 by a half step and the ink sheet 14 by 4–6 half steps, and to record a line with the same data.

Upon completion of recording of l lines corresponding to respective recording mode, the sequence proceeds to a step S18 to discriminate whether the recording of a page has been completed. If not, steps S24–S27 transfer the recording data of a next line to the thermal head 13, and effect auxiliary recording to the already recorded lines. Said auxiliary recording is conducted by energizing the heat generating resistors 132 of the thermal head 13 again with the already recorded data, with an energizing time of about ¼ of that in the ordinary recording.

When the step S18 identifies completion of image recording of a page, a step S19 advances the recording sheet 11 by a predetermined amount toward the discharge rollers 16 (16*a*, 16*b*), and a step S20 advances the ink sheet 14 by (predetermined amount×1/20). The amount of transportation of the ink sheet in this step is smaller than that with respect to the amount of transportation of the recording sheet at the image recording. Then a step S21 activates the cutter members 15 (15*a*, 15*b*) to cut the recording sheet into a page size. The cut recording sheet 11 is discharged from the apparatus by the discharge rollers 16. Then a step S22 reverses the remaining recording sheet 11 by a length corresponding to the distance between the thermal head 13 and the cutter members 15 (predetermined amount-α). Also a step S23 reverses the ink sheet 14 by (predetermined amount-α)×1/20, and the recording process of a page is thus terminated. Said value α is provided for preventing the separation of the recording sheet from the platen roller when the recording sheet is reversed.

On the other hand, if the step S5 identifies the fine mode, the sequence proceeds to a step S31 to transport the recording sheet 11 by 2 half steps and to set the number l of repeated recordings at "2". Then a step S32 discriminates whether the temperature t exceeds 35° C., and, if affirmative, a step S33 advances the ink sheet 14 by 8 half steps. If the temperature t does not exceed 35°

C. but exceeds 25° C., a step S34 advances the ink sheet 14 by 10 half steps. If the temperature is equal to or less than 25° C., a step S36 advances the ink sheet 14 by 12 half steps. Thereafter the sequence proceeds to the step S12 for energizing the thermal head 13.

In case of the standard mode, the sequence proceeds to the step S5 to S41 for advancing the recording sheet 11 by 4 half steps and setting the number l at "4". Then, if the temperature t exceeds 35° C., the sequence proceeds to a step S42 to S43 to advance the ink sheet by 16 half steps. If the temperature t does not exceed 35° C. but exceeds 25° C., a step S45 advances the ink sheet 14 by 20 half steps. If the temperature t is equal to or less than 25° C., the sequence proceeds from a step S44 to S46 to advance the ink sheet 14 by 24 half steps, and the sequence thereafter proceeds to the step S12.

FIG. 6 illustrates the above-explained relationship between the temperature t and the value n.

When the temperature t exceeds 35° C., the value n is selected larger (moving amount of the ink sheet 14 is selected smaller with respect to that of the recording sheet 11). In case of 35° C.≧t<25° C. the value n is selected at a medium value, and, in case of 25° C.≧t, the value n is selected smaller (moving amount of the ink sheet 14 is selected larger with respect to that of the recording sheet 11).

FIG. 7 shows the moving distance of the recording sheet 11 per line in different recording modes.

Taking the half step drive into consideration, the recording sheet transport motor 24 advances the recording sheet 11 by 1/15.4 mm in a half step. Said motor 24 is driven by a half step in a line of the super fine mode, or 2 half steps in a line of the fine mode, or 4 half steps in a line of the standard mode.

FIG. 8 shows the number of steps required to transport the ink sheet 14 by a line in the different recording modes of the present embodiment.

In the present embodiment, the ink sheet transport motor 25 advances the ink sheet 14 by $\{(1/15.4)\times 1/5\times 1/5\}$ mm in a half step. Thus, in the super fine mode, the motor 25 advances the ink sheet 14 by 4, 5 or 6 half steps respectively for the large, medium or small value of n. Similarly, in the fine mode, the motor 25 advances the ink sheet 14 by 8, 10 or 12 half steps respectively for the large, medium or small value of n. Also in the standard mode, the motor 25 advances the ink sheet 14 by 16, 20 or 24 half steps respectively for the large, medium or small value of n.

Consequently, for example in the super fine mode, the transportation ratio n of the recording sheet 11 to the ink sheet 14 is $(5\times 5)\times \frac{1}{4}=25/4$ for a large value of n, or $(5\times 5)\times 1/5=5$ for a medium value of n, or $(5\times 5)\times 1/6=25/6$ for a small value of n. The ink sheet 14 is transported by 4–6 half steps for every transportation of the recording sheet 11 by a half step.

In the present embodiment, the transportation ratio n of the ink sheet 14 and the recording sheet 11 is varied according to the temperature of the thermal head 13 as the temperature information, but the present invention is not limited to such embodiment. For example, the value n may be varied for example according to the ambient temperature of the location where the apparatus is installed.

Also instead of variation of n according to the temperature information in the foregoing embodiment, it is possible to vary the value n for example according to the humidity.

FIG. 9 shows such embodiment, in which the value n is selected large, medium or small respectively when the humidity h exceeds 70%, 70% ≧h>50%, or 50%≧h.

Also the value n may be varied based on both temperature and humidity.

Furthermore, in the foregoing embodiment, the value n is rendered variable by detecting the ambient condition such as temperature at the recording of each line, but it is also possible, for example, to record a page with a constant value n, and to vary said value n based on the measurement of ambient condition at the end of page.

Figure 10:
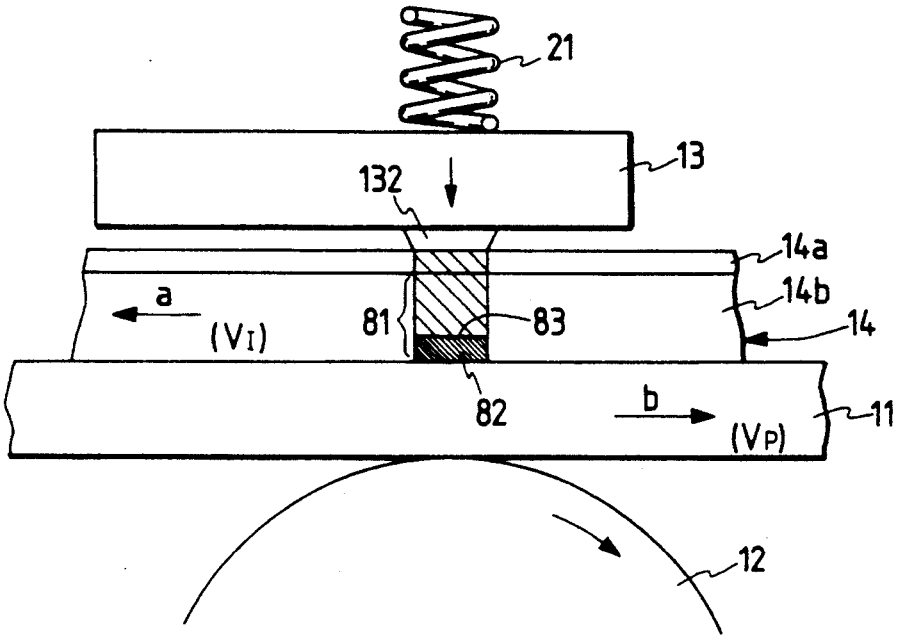
FIG. 10 is a cross sectional view showing the state of the recording sheet and the ink sheet at the recording in these embodiments.

Recording principle (FIG. 10)

FIG. 10 illustrates the state of image recording, employing a multi ink sheet in the thermal transfer printer of the present embodiment, with mutually opposite transporting directions for the recording sheet 11 and the ink sheet 14.

The recording sheet 11 and the ink sheet 14 are pinched between the platen roller 12 and the thermal head 13, which is pressed to the platen roller 12 under a predetermined pressure exerted by the spring 21. The recording sheet 11 is transported in a direction b with a speed $V_P$, by the rotation of the platen roller 12, while the ink sheet 14 is transported in a direction a with a speed $V_I$ by the rotation of the ink sheet transport motor 25.

When the heat generating resistors 132 of the thermal head 13 are energized by the power source 105, a hatched portion 81 of the ink sheet 14 is heated. The ink sheet 14 is composed of a substrate film 14*a*, and an ink layer 14*b*. The ink of thus heated ink layer 81 is fused, and a part 82 thereof is transferred onto the recording sheet 11. The transferred ink layer portion 82 corresponds approximately to 1/n of the ink layer 81.

Figure 11:
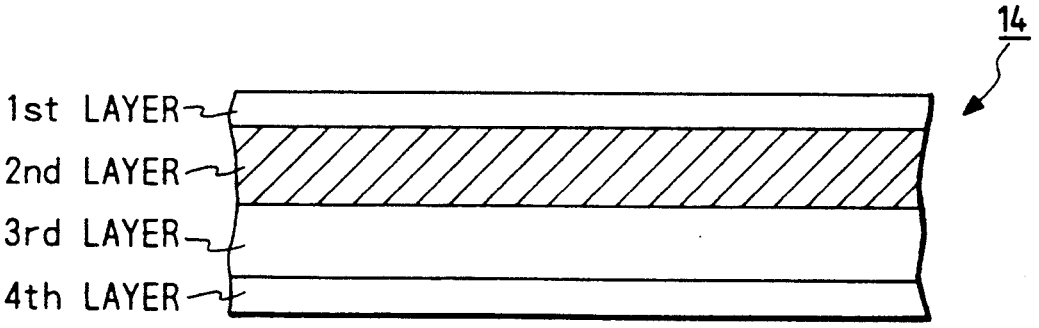
FIG. 11 is a cross sectional view of the multi ink sheet employed in said embodiments.

Ink sheet (FIG. 11)

FIG. 11 is a cross-sectional view of the ink sheet employed in the multi printing process of the present embodiment and composed of four layer in this case.

A substrate film of the ink sheet 14 constitutes a second layer. In case of multi printing, as a same part of the ink sheet is subjected to thermal energy application plural times, said substrate is advantageously composed of an aromatic polyamide film or a condenser paper with a high thermal resistance, but a conventional polyester film may also be used for this purpose. The thickness is preferably as small as possible for improving the print quality, but is desirably in a range of 6–8 microns in consideration of the strength.

A third layer is an ink layer containing ink in an amount enough for transfers of n times onto the recording sheet. Said ink layer is principally composed of a resinous adhesive such as EVA, a coloring material such as carbon black or nigrosin dye, and a binding material such as Carnauba wax or paraffin wax, so mixed as to enable the transfer of n times in a same place. The coating amount of said ink layer is generally in a range of 4–8 g/m$^2$, but can be arbitrarily selected according to the desired sensitivity and density.

A fourth layer is a top coating for preventing the transfer the third layer by pressure to the recording sheet in a non-printed area, and is composed for example of transparent wax. Thus the transfer by pressure takes place only in the fourth layer, and the recording sheet can be protected from the background smudge. A first layer is a heat resistant coating for protecting the substrate film of the second layer from the heat of the thermal head 13. Such top coating is preferably for the multi-printing ink sheet in which thermal energy of n lines may be applied to a same position (when black information continues), but the presence or absence of such top coating may be arbitrarily selected. Also such top coating is effective for a substrate film of a relatively low thermal resistance, such as a polyester film.

The structure of the ink sheet 14 is not limited to the embodiment explained above, but may also be composed of a substrate layer and a porous ink holding layer containing ink therein and provided on a side of said substrate layer, or of a heat resistant ink layer consisting of a porous network structure formed on a substrate film and impregnated with ink. Also said substrate film may be composed, for example, of polyamide, polyethylene, polyester, polyvinyl chloride, triacetyl cellulose, nylon or paper. Also the heat resistant top coating, which is not necessarily indispensable, may be composed, for example, of silicon resin, epoxy resin, fluorinated resin or nitrocellulose.

Also an ink sheet with heat-sublimable ink can be composed, for example, of a substrate film of polyethylene terephthalate, polyethylene naphthalate or aromatic polyamide, and a coloring material layer formed thereon and containing dyes and spacer particles formed from guanamine resin and fluorinated resin.

Also the heating in the thermal transfer printer is not limited to the thermal head method explained above, but may also be achieved for example by direct current supply or by laser beam irradiation.

Also the foregoing embodiments have been limited to the printers with a thermal line head, but the present invention is likewise applicable to the thermal transfer printers of so-called serial type.

Also the recording medium is not limited to a recording paper but can be of any material capable of accepting ink transfer, such as cloth, or plastic sheet. Furthermore the ink sheet is not limited to the rolled structure shown in the foregoing embodiments, but can be of so-called ink sheet cassette structure, in which a casing incorporating ink sheet is detachably mounted in the main body of the apparatus.

Furthermore, though the foregoing embodiments have been limited to facsimile apparatus, the present invention is not limited to such embodiments and is likewise applicable to a word processor, a typewriter, a copying machine or the like.

Furthermore, the advancement of the ink sheet may be achieved by the winding operation of the take-up roller 18.

As explained above, the foregoing embodiments reduces or increases the amount of transportation of the ink sheet with respect to that of the recording sheet respectively under an easy or difficult condition for fusion or sublimation of the ink sheet, thereby achieving effective use of the ink sheet and maintaining a constant recording density, thus improving the quality of recorded image.

As explained in the foregoing, the present invention decreases the amount of transportation of the ink sheet under a condition where the ink of the ink sheet is easily transferred, thereby saving the consumption of the ink sheet, and increases said amount of transportation under a condition where the ink transfer is more difficult. Thus the present invention provides advantages of economizing the ink sheet and recording satisfactory images.

We claim:

1. A thermal transfer recording apparatus for recording an image on a recording medium by transferring an ink thereto from an ink sheet, comprising:

ink sheet transport means for transporting said ink sheet, said ink sheet being of a type such that recording can be performed more than once using any given portion of said ink sheet;

recording medium transport means for transporting said recording medium;

recording means for acting on said ink sheet transported by said ink sheet transport means and for recording said image on said recording medium;

measuring means for measuring a temperature contributing to a transfer condition of said ink to said recording medium; and variation means for varying an amount of transportation of said ink sheet with respect to said recording medium, according to the temperature measured by said measuring means, wherein said variation means decreases the amount of transportation of said ink sheet when the temperature measured by said measuring means is higher than a predetermined temperature and increases the amount of transportation of said ink sheet when the temperature measured is lower than said predetermined temperature.

2. An apparatus according to claim 1, wherein said recording means comprises a recording head provided with heat generating elements.

3. An apparatus according to claim 2, wherein said measuring means is adapted to measure the temperature of said recording head.

4. An apparatus according to either one of the claims 1 to 3, wherein said ink sheet and said recording medium are transported in mutually opposite directions.

5. A facsimile apparatus employing a thermal transfer recording apparatus for recording an image on a recording medium by transferring an ink thereto from an ink sheet, comprising:

communication means for communicating image data;

ink sheet transport means for transporting said ink sheet, said ink sheet being of a type such that recording can be performed more than once using any given portion of said ink sheet;

recording medium transport means for transporting said recording medium;

recording means for acting on said ink sheet transported by said ink sheet transport means and for recording said image on said recording medium according to the image data communicated by said communication means;

measuring means for measuring a temperature contributing to a transfer condition of said ink to said recording medium; and variation means for varying an amount of transportation of said ink sheet with respect to said recording medium, according to the temperature measured by said measuring means, wherein said variation means decreases the amount of transportation of said ink sheet when the temperature measured by said measuring means is higher than a predetermined temperature and increases the amount of transportation of said ink sheet when the temperature measured is lower than said predetermined temperature.

6. An apparatus according to claim 5, wherein said recording means comprises a recording head provided with heat generating elements.

7. An apparatus according to claim 6, wherein said measuring means is adapted to measure the temperature of said recording head.

8. An apparatus according to either one of claims 5 to 7, wherein said ink sheet and said recording medium are transported in mutually opposite directions.

9. An apparatus according to claim 8, further comprising reader means for reading an original image for the purpose of transmission or copying.

* * * * *

UNITED STATES PATENT AND TRADEMARK OFFICE

CERTIFICATE OF CORRECTION

PATENT NO. : 5,266,971

DATED : November 30, 1993

INVENTOR(S) : TAKEHIRO YOSHIDA, ET AL.

It is certified that error appears in the above-identified patent and that said Letters Patent is hereby corrected as shown below:

IN THE DRAWINGS

Sheet 1 of 11, FIG. 1, "TERMAL HEAD" should read --THERMAL HEAD--.

COLUMN 6

Line 16, "to ,the" should read --to the--.
Line 26, "(" should read --ℓ--,

COLUMN 7

Line 22, "35°C.≧t<25°C." should read --35°C.≧t>25°C.--.

COLUMN 8

Line 39, "layer" should read --layers--.
Line 61, "transfer" should read --transfer of--.

COLUMN 9

Line 52, "duces or increases" should read --duce or increase--.

COLUMN 10

Line 34, "either" should read --any--.

COLUMN 11

Line 7, "either" should read --any--.

UNITED STATES PATENT AND TRADEMARK OFFICE

CERTIFICATE OF CORRECTION

PATENT NO. : 5,266,971

DATED : November 30, 1993

INVENTOR(S) : TAKEHIRO YOSHIDA, ET AL.

It is certified that error appears in the above-identified patent and that said Letters Patent is hereby corrected as shown below:

COLUMN 12

Line 3, "claim 8," should read --claim 5,--.

Signed and Sealed this

Ninth Day of August, 1994

Bruce Lehman

*Attest:*

BRUCE LEHMAN

*Attesting Officer*

*Commissioner of Patents and Trademarks*